United States Patent [19]

Case et al.

[11] Patent Number: 4,964,427

[45] Date of Patent: Oct. 23, 1990

[54] SMOKING ARTICLES

[75] Inventors: Paul D. Case; David J. Dittrich, both of Southampton, England

[73] Assignee: British-American Tobacco Company, Ltd., London, England

[21] Appl. No.: 239,913

[22] Filed: Sep. 2, 1988

[30] Foreign Application Priority Data

Sep. 3, 1987 [GB] United Kingdom ..... 8720726
Dec. 16, 1987 [GB] United Kingdom ..... 8729389

[51] Int. Cl.[5] ..... A24D 1/02

[52] U.S. Cl. ..... 131/365; 131/331; 131/364

[58] Field of Search ..... 131/365, 336, 331, 364

[56] References Cited

U.S. PATENT DOCUMENTS

Re. 32,615 3/1988 Luke ..... 131/360
4,225,636 9/1980 Cline et al. ..... 131/365
4,624,268 11/1986 Baker et al. ..... 131/365

FOREIGN PATENT DOCUMENTS 0175148 6/1953 Austria ..... 131/365

*Primary Examiner*—V. Millin
*Attorney, Agent, or Firm*—Charles G. Lamb

[57] ABSTRACT

Low sidestream cigarettes comprise at least 20% expanded tobacco and a cigarette paper comprising a burn retardant.

14 Claims, 2 Drawing Sheets

Fig. 3.
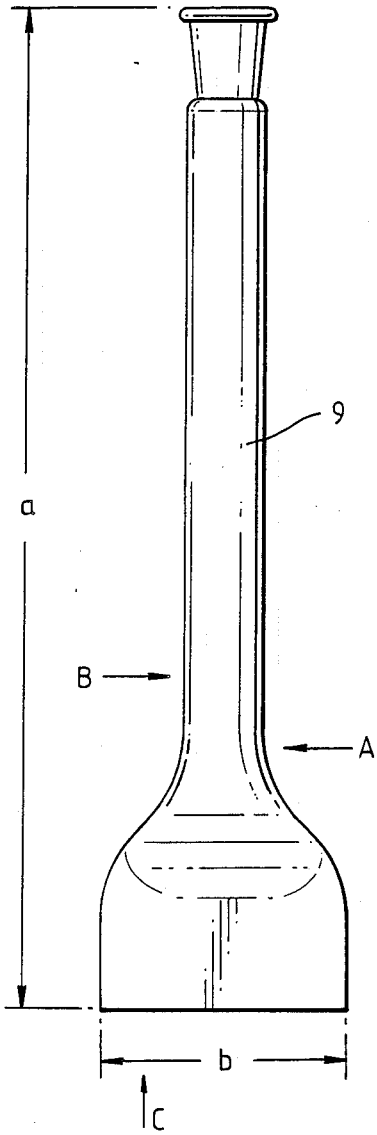
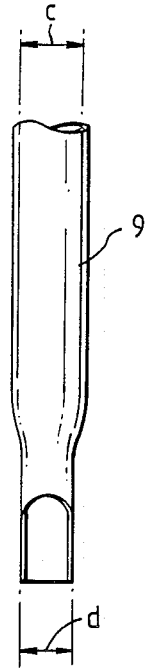
Fig. 4.
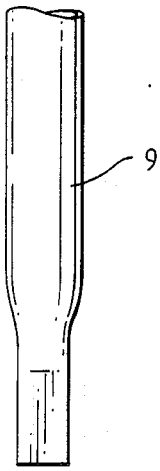
Fig. 5.
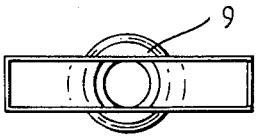
Fig. 6.

SMOKING ARTICLES

The invention the subject of this application relates to cigarettes and similar smoking articles.

A number of approaches have been suggested to the provision of cigarettes which exhibit low deliveries of sidestream smoke components. Thus according to the teaching of United Kingdom Patent Specification No. 2 094 130A cigarettes comprising cigarette papers having air permeabilities due to viscous flow of not more than 3 Coresta units and Do/t ratios of 0.08 to 0.65 cm $sec^{-1}$, where Do signifies the coefficient of diffusion of oxygen through nitrogen in paper and t signifies the thickness of the cigarette paper, exhibit low deliveries of total particulate matter, water and nicotine free (PMWNF), and nicotine in the sidestream smoke.

A further approach to the obtainment of low component deliveries in the sidestream smoke of cigarettes is by way of using cigarette papers comprising one or more sidestream reducing compounds. In United Kingdom Patent Specification No. 2 139 869A there is a disclosure relating to cigarette papers comprising one or more of the compounds of the group consisting of lithium hydroxide, aluminium hydroxide, calcium hydroxide, potassium formate, sodium formate and sodium acetate. The total particulate matter in the sidestream smoke which emanates from cigarettes comprising such papers is reduced by at least 30% compared with a comparable cigarette comprising a conventional cigarette paper. Another example of the use of sidestream reducing compounds is disclosed in U.S. Pat. No. 4,231,377, according to the teaching of which magnesium oxide and an adjuvant salt in combination are incorporated in cigarette papers.

It is an object of the subject invention to provide improved low sidestream cigarettes or similar low sidestream smoking articles.

The subject invention provides a smoking article comprising a smoking material rod, which rod comprises smoking material and a paper wrapper circumscribing said smoking material, the density of said smoking material in said rod being in a range of about 100 mg $cm^{-3}$ to about 260 mg $cm^{-3}$, said smoking material comprising at least about 20% by weight of expanded tobacco, said wrapper comprising a burn retardant and said smoking article, when smoked under standard machine smoking conditions, providing not less than six puffs.

As used herein "standard machine smoking conditions" refers to Coresta standard machine smoking conditions, according to which a 35 $cm^3$ puff of two seconds duration is taken every minute.

Smoking articles in accordance with the subject invention should preferably exhibit, when smoked under standard machine smoking conditions, a total yield of sidestream PMWNF not exceeding about 17 mg per smoking article, more preferably not exceeding about 15 mg and even more preferably not exceeding about 10 mg.

Smoking articles in accordance with the subject invention should preferably exhibit, when smoked under standard machine smoking conditions, a total yield of sidestream carbon monoxide (CO) not exceeding about 35 mg, more preferably not exceeding about 30 mg and even more preferably not exceeding about 20 mg.

Smoking articles in accordance with the subject invention should preferably exhibit, when smoked under standard machine smoking conditions, a smoking material consumption in the inter-puff periods not exceeding about 50% of the total smoking material consumption, i.e. the combined smoking material consumption in the inter-puff periods and in the puffs. More preferably, the inter-puff smoking material consumption should not exceed about 40% of the total smoking material consumption and even more preferably should not exceed about 30% of the total smoking material consumption.

In smoking articles according to the present invention smoking material not being expanded tobacco preferably comprises leaf tobacco, suitably in conventional cut filler form. The leaf tobacco may be lamina and/or stem tobacco. Smoking material not being expanded tobacco may comprise a reconstituted tobacco or a tobacco substitute.

The expanded tobacco may be lamina and/or stem tobacco. The expanded tobacco is advantageously a lamina tobacco the product of a tobacco expansion process which is effective to provide a high degree of expansion in tobacco subjected to the process. High expansion processes are disclosed, for example, in the specification of U.S. Reissue Pat. No. 30,693 and in United Kingdom Patent Specifications Nos. 1,570,270 and 2 160 408A. By the use of high expansion processes, tobacco expansion values, in terms of filling value increase, of from about, typically, 75% and even up to about 125% may be obtained. Tobacco which has been subjected to a high expansion process may have a bulk density of, for example, from about 100 mg $cm^{-3}$ to about 175 mg $cm^{-3}$, as measured using a Borgwaldt Densimeter.

The proportion of the smoking material accounted for by expanded tobacco is preferably at least about 30% by weight.

As will be apparent to skilled-in-the-art addressees, if the expansion of the expanded tobacco is of a low order, it may be required that the proportion of the smoking material accounted for by expanded tobacco approaches, or is at, 100%.

As used herein, the term "burn retardant" means a substance the inclusion of which in or on a paper wrapper of a smoking material rod effects a reduction in the smoulder rate of the smoking material rod. It is to be understood that "burn retardant" refers to the use of two or more such substances, as well as to the use of a single such substance. Among the substances which can be used, singly or in combination, as burn retardants are aluminium ammonium sulphate, di-ammonium hydrogen orthophosphate, ammonium di-hydrogen orthophosphate and sodium di-hydrogen orthophosphate. Other substances which can be used as burn retardants for the purposes of the subject invention include boric acid, aluminium borate, calcium borate, ammonium bromide, lithium bromide, magnesium bromide, ammonium chloride, magnesium chloride, zinc chloride, aluminium phosphate, calcium phosphate, potassium silicate, aluminium sulphate, calcium sulphate, magnesium sulphate and sodium carbonate.

Water soluble substances used as burn retardants are preferably applied to the wrapper paper in aqueous solution. If a substance used as a burn retardant is not water soluble, the substance is suitably added in powder form as a filler to the paper furnish during the paper making process. Water soluble burn retardant substances may be applied to the paper to give a loading which suitably does not exceed about 20%. Non water soluble burn retardants may be present at a loading level of up to about 30%.

Wrapper paper for use in smoking articles according to the subject invention may comprise, in addition to a burn retardant substance or substances, a sidestream reducing filler substance such, for example, as aluminium hydroxide, lithium hydroxide or magnesium hydroxide.

Suitably, the air permeability of wrapper paper for use in smoking articles according to the subject invention does not exceed about 20 Coresta units. The air permeability of a paper is expressed in Coresta units as the amount of air, in cubic centimetres, which passes through one square centimetre of the paper in one minute at a constant pressure difference of 1.0 kilopascal.

Inherently porous cigarette paper consists of an interlocking network of fibres, which fibres are usually substantially wholly or mainly cellulose fibres, interspersed with particles of a filler, calcium carbonate for example. Openings in the fibre/filler matrix are of the order of 1 μm wide, which dimension is small compared with the thickness of the paper (usually 20 to 50 μm) and the flow of air through such openings is governed by viscous forces. However, when paper is perforated after the paper making process, the perforations are relatively large, usually having width dimensions of the same order of magnitude as the paper thickness, and the flow of air through such perforations is governed by inertial forces.

It is thus to be observed that when the permeability of a perforated paper is determined in accordance with the Coresta permeability determination method, the permeability value obtained will comprise the sum of the permeability due to viscous flow through the openings inherent from the paper making process and the permeability due to inertial flow through the perforations. A paper will also exhibit the same two permeability components if, although not perforated, the paper comprises, in addition to the small, viscous flow holes, larger inertial flow holes, which latter holes may be referred to as pinholes. Paper of this last mentioned construction may result, for example, from a defective paper making technique.

The total air flow through a paper may be expressed as:

$$Q=ZAP=Z'A(P)^n$$

where

Q is the air flow ($cm^3\ min^{-1}$)

A is the area of paper ($cm^2$) exposed to the flowing air

P is the pressure difference across the paper (kilopascals)

Z is the permeability of the paper due to viscous flow through the openings inherent from the paper making process in Coresta units (cm $min^{-1}$ kilopascal$^{-1}$)

Z' is the permeability of the paper due to intertial flow through perforations and/or pinholes (cm $min^{-1}$ kilopascal$^{-1}$) and n is a constant for a given set of perforation holes or pinholes, where $0.5 \leqq n < 1.0$, the exact value of n depending on the size of the perforations or pinholes.

The total permeability of a paper comprising perforations and/or pinholes is (Z+Z') and the relative values of Z and Z' for a given such paper can be obtained by measuring the flow of air through the paper at a series of pressure differences across the paper and numerically regressing the Q/P data in the above equation using a value of n in accordance with the mean size of the perforations/pinholes in the paper.

It is to be understood that the value of 20 Coresta units recited above in relation to the wrappers of smoking articles according to the subject invention refers to the permeability of the wrappers due to viscous flow. It will thus be appreciated that it is conveivable for a wrapper of a smoking article according to the subject invention to have a total permeability, i.e. the permeability determined using the Coresta permeability determination method, exceeding 20 Coresta units should the wrapper comprise perforations and/or pinholes.

The length of smoking material rods of smoking articles in accordance with the subject invention is preferably not less than 45 mm and is advantageously at least 60 mm. The smoking material rods are preferably of uniform cross-sectional shape and dimensions throughout the lengths thereof. If, as is commonly the case with cigarettes and like smoking articles, a smoking material rod of a smoking article in accordance with the subject invention is of a uniform circular cross-section, the circumference of the rod may be in a range of 10 mm to 30 mm. Whereas significant and commercially useful sidestream smoke reduction advantages are to be obtained from smoking articles in accordance with the present invention when the rod circumference is 25±5 mm, exceptional such advantages are to be obtained when the rod circumference is below the 25±5 mm range down to 10 mm. Preferably, the rod circumference of smoking articles according to the subject invention is not less than 12.5 mm.

When smoked under standard machine smoking conditions, smoking articles in accordance with the subject invention advantageously provide not less than seven puffs and more preferably not less than eight puffs.

Preferably, smoking articles in accordance with the subject invention comprise filter or mouthpiece means attached to the smoking material rod at one end thereof.

Smoking articles in accordance with the subject invention may incorporate ventilation means.

It is conceivable that in smoking articles in accordance with the subject invention the paper used for the wrapper could be other than orthodox paper. It might, for example, be a reconstituted tobacco sheet material.

In order to further the understanding of the subject invention, examples according thereto will now be described.

BRIEF DESCRIPTION OF THE DRAWINGS

FIGS. 3 to 6 show, diagrammatically, a fishtail chimney forming part of the apparatus shown in FIG. 2; FIGS. 4 to 6 being views on FIG. 3 taken in the directions of arrows A, B and C respectively.

EXAMPLE I

Figure 1:
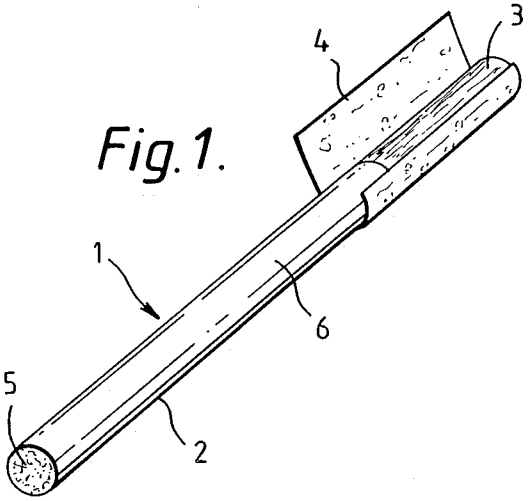
FIG. 1 of the drawings hereof shows a cigarette with a tipping wrapper thereof partially unwrapped.

There was produced a cigarette 1 as illustrated in FIG. 1 according to the subject invention consisting of a cigarette rod 2, of a length of 64 mm and a circumference of 24.82 mm, and a 20 mm long cellulose acetate filter 3 attached to the rod 2 by means of a tipping wrapper 4. The rod 2 comprised an all lamina cut tobacco filler 5 wrapped in a circumscribing cigarette paper wrapper 6. The filler 5 was 80% cut lamina tobacco which had been expanded by use of the high expansion process known as the DIET process. The density of the filler 5 was 159 mg $cm^{-3}$. The cigarette paper of wrapper 6 was of an air permeability of 9 Coresta units and a substance of 27.1 g $m^{-2}$. The cigarette paper contained 23.7% of a calcium carbonate filler. A burn retardant solution of 4 parts of ammonium dihydrogen orthophosphate and 1 part of di-ammonium hydrogen orthophosphate had been applied to the wrapper 6 to provide a 14% loading thereon.

When cigarettes as per cigarette 1 were smoked under standard machine smoking conditions to a cigarette rod butt length of 8 mm, the average total yields per cigarette of sidestream PMWNF and CO were 10.0 mg and 21.0 mg respectively. The average puff number of these cigarettes was 8.6.

Second cigarettes according to the subject invention comprised cigarette rods, of a length of 64 mm and a circumference of 24.87 mm, and 20 mm long cellulose acetate filters. The cigarette rods comprised an all lamina cut tobacco filler comprising 80% DIET expanded tobacco and having a density of 163 mg $cm^{-3}$. The rods were wrapped in a cigarette paper of an air permeability of 15 Coresta units and a substance of 42 g $m^{-2}$. The cigarette paper contained as filler a mixture of calcium carbonate and magnesium hydroxide, at respective loading levels in the paper of 23.5% and 16.0%. Magnesium chloride, as burn retardant, had been applied in solution to the paper to provide a loading level of the magnesium chloride of 3.9%.

When the second cigarettes were smoked under standard machine smoking conditions the average total yields per cigarette of sidestream PMWNF and CO were 9.7 mg and 23.1 mg respectively. The average puff number was 9.5.

Third cigarettes according to the subject invention comprised cigarette rods, of a length of 64 mm and a circumference of 24.82 mm, and 20 mm cellulose acetate filters. The cigarette rods comprised an all lamina cut tobacco filler comprising 80% DIET expanded tobacco and having a density of 167 mg $cm^{-3}$. The rods were wrapped in a cigarette paper of an air permeability of 18 Coresta units and a substance of 42 g $m^{-2}$. The cigarette paper contained as filler a mixture of calcium carbonate and magnesium hydroxide, at respective loading levels in the paper of 23.5% and 16.0%. Aluminium ammonium sulphate, as burn retardant, had been applied in solution to the paper to provide a loading level of the burn retardant of 2.6%.

When the third cigarettes were smoked under standard machine smoking conditions the average total yields per cigarette of sidestream PMWNF and CO were 16.2 mg and 31.6 mg respectively. The average puff number was 8.

EXAMPLE II

Fourth cigarettes according to the subject invention comprised cigarette rods, of a length of 64 mm and a circumference of 25 mm, and 20 mm cellulose acetate filters. The cigarette rods comprised and all lamina cut tobacco filler comprising 80% by weight DIET expanded tobacco and having a density of 166 mg $cm^{-3}$. The rods were wrapped in a cigarette paper as per that designated 'A' in Table 2 below.

When the fourth cigarettes were smoked under standard machine smoking conditions the average total yields per cigarette of sidestream PMWNF, total nicotine alkaloids (TNA) and CO were 16.2 mg, 2.25 mg and 31.6 mg respectively. The average puff number of the fourth cigarettes was 7.2.

When first comparable control cigarettes, comprising 100% of an unexpanded tobacco filler wrapped in a conventional cigarette paper of 50 Coresta units air permeability, were smoked according to the just mentioned smoking regime, the average total yields per cigarette of sidestream PMWNF, TNA and CO were 31.3 mg, 4.80 mg and 64.7 mg respectively. The average puff number of the first control cigarettes was 9.1.

When second comparable control cigarettes, comprising the same filler as that of the above referred to fourth cigarettes and further comprising conventional cigarette paper as per that of the first control cigarettes, were smoked according to the same smoking regime, the average total yields per cigarette of sidestream PMWNF, TNA and CO were 19.1 mg, 3.67 mg and 35.0 mg respectively. The average puff number of the second control cigarettes was 6.2.

When unexpanded filler as per that of the first control cigarettes was employed to provide 100% of the filler of third comparable control cigarettes, comprising rod wrappers of paper A, and the third control cigarettes were smoked, again under standard machine smoking conditions to a butt length of 8 mm, the average total yields per cigarette of sidestream PMWNF, TNA and CO were 24.5 mg, 3.96 mg and 61.8 mg respectively. The average puff number of the third control cigarettes was 11.3.

It may be readily calculated from the results obtained in smoking the control cigarettes that on a directly linearly proportional basis the expected average total sidestream yields of PMWNF, TNA and CO for comparable cigarettes comprising both the above referred to filler comprising 80% DIET expanded tobacco and a wrapper of paper A, i.e. cigarettes as per the fourth cigarettes, would be 14.9 mg, 3.0 mg and 33.4 mg respectively per cigarette. (The PMWNF value, for example, is calculated as 24.5 (1–0.39)=14.9, 24.5 being the PMWNF for the third control cigarettes and 0.39 being the value of PMWNF for the first control cigarettes minus that for the second control cigarettes expressed as a fraction of that for the first control cigarettes, i.e. PMWNF reduction ratio.) However, as already mentioned, the measured total sidestream yields of TNA and CO for the fourth cigarettes were 2.25 mg and 31.6 mg respectively. It is thus to be observed that the average total sidestream yield of TNA for cigarettes as per the fourth cigarettes, being cigarettes in accordance with the subject invention, was 25% less than the calculated value. Similarly, for CO the fourth cigarettes had a sidestream delivery 6% less than predicted. In other words, the cigarettes in accordance with the subject invention exhibited a distinctly synergistic sidestream smoke component reduction effect.

Details are given in Table 1 of average total sidestream component yields and puff numbers for cigarettes in accordance with the subject invention. The cigarettes comprising a wrapper of a paper designated A are those referred to above as being the fourth cigarettes. The other cigarettes were comparable except in comprising respectively papers designated B to G. These other cigarettes were smoked in accordance with the smoking regime hereinabove mentioned.

In Table 2 there are presented details of the papers A to G.

In Table 1 the letter 'S' beneath values shown in Columns 5 to 7 denotes a synergistic sidestream smoke component reduction effect. As may be observed of Table 1 synergism in terms of sidestream component reduction is a feature of each of the cigarette constructions embodying wrappers of papers A to G.

TABLE 1

| 1 | 2 | 3 | 4 | 5 | 6 | 7 | 8 |
|---|---|---|---|---|---|---|---|
| | Predicted Sidestream Component Yields - mg $cig^{-1}$ | | | Measured Sidestream Component Yields - mg $cig^{-1}$ | | | |
| Paper | PMWNF | TNA | CO | PMWNF | TNA | CO | Puff No. |
| A | 14.9 | 3.0 | 33.4 | 16.2 | 2.25 S | 31.6 S | 7.2 |
| B | 10.7 | 2.63 | 28.2 | 9.7 | 1.74 S | 23.1 S | 9.8 |
| C | 14.6 | 3.18 | 29.4 | 13.9 | 2.02 S | 31.1 | 7.2 |
| D | 12.9 | 3.11 | 25.1 | 10.0 | 1.27 S | 21.0 S | 8.6 |
| E | 13.2 | 3.20 | 27.7 | 13.0 | 1.68 S | 23.8 S | 9.2 |
| F | 11.8 | 3.33 | 25.4 | 13.6 | 2.24 S | 30.5 | 8.1 |
| G | 11.5 | 2.23 | 27.8 | 9.5 | 1.29 S | 21.7 S | 9.5 |

TABLE 2

| Paper Designation | Permeability (C.U.) | Substance (g $m^{-2}$) | Filler (% wt) | Burn Retardant (% wt) |
|---|---|---|---|---|
| A | 12 | 46 | 23.5 $CaCO_3$ 11.5 MgO | 2.6 $Al(NH_4)(SO_4)2$ |
| B | 12 | 46 | 23.5 $CaCO_3$ 11.5 MgO | 4.0 $MgCl_2$ |
| C | 12 | 46 | 23.5 $CaCO_3$ 11.5 MgO | 5.5 of mixture |
| D | 9 | 27 | 23.7 $CaCO_3$ | 14 of mixture |
| E | 9 | 27 | 23.7 $CaCO_3$ | 10 $MgCl_2$ |
| F | 9 | 27 | 23.7 $CaCO_3$ | 11 $NaH_2PO_4$ |
| G | 9 | 50 | 15 $CaCO_3$ 8.7 Mgo | 6.9 $MgCl_2$ |

The burn retardant mixture referred to in Table 2 in connection with papers C and D was a mixture of 4 parts of ammonium di-hydrogen orthophosphate and 1 part of diammonium di-hydrogen orthophosphate and 1 part of di-ammonium hydrogen orthophosphate. In Table 2 the filler loadings are expressed as a percentage of the paper substance prior to addition of the burn retardant, and the burn retardant loadings are expressed as a percentage of the final paper weight. The permeability values of the papers A to G given in Table 2 are as specified prior to the addition of burn retardant. However, the addition of burn retardant, by way of aqueous solution, had no significant effect on the permeability of any of the papers.

EXAMPLE III

Cigarettes according to the subject invention comprised cigarette rods, of a lenth of 64 mm and a circumference of 17 mm, and 20 mm long cellulose acetate filters, the filters being also, of course, of 17 mm circumference. The cigarette rods comprised an all lamina cut tobacco filler comprising 80% DIET expanded tobacco and having a density of 181 mg $cm^{-3}$. The rods were wrapped in a cigarette paper as per that desinated 'G' in Table 2. When these cigarettes were smoked under standard machine smoking conditions the average total yields per cigarette of sidestream PMWNF, TNA and CO were 5.6 mg, 0.73 mg and 2.5 mg respectively. The average puff number was 14.1.

When first comparable control cigarettes, comprising 100% of an unexpanded filler wrapped in a conventional cigarette paper of 50 Coresta units air permeability, were smoked under standard machine smoking conditions, the average total yields per cigarette of sidestream PMWNF, TNA and CO were 18.5 mg, 3.29 mg and 42.4 mg respectively. The average puff number was 7.9.

When second comparable control cigarettes, comprising the same filler as that of the cigarettes according to the subject invention and further comprising conventional cigarette paper as per that of the first control cigarettes, were smoked under standard machine smoking conditions, the average total yields per cigarette of sidestream PMWNF, TNA and CO were 10.7 mg, 1.55 mg and 25.2 mg respectively. The average puff number was 5.1.

When unexpanded filler as per that of the first control cigarettes was employed to provide 100% of the filler of third comparable control cigarettes, comprising rod wrappers of paper G, and the third control cigarettes were smoked, again under standard machine smoking conditions, the average total yields per cigarette of sidestream PMWNF, TNA and CO were 11.1 mg, 2.15 mg and 21.2 mg respectively. The average puff number was 14.1.

From the sidestream component delivery values for the control cigarettes it may be calculated, in the manner detailed in Example II, that the values of the total yields of sidestream PMWNF, TNA and CO for the cigarettes according to the subject invention would be expected to be 6.4 mg, 1.01 mg and 12.5 mg respectively. In that the corresponding measured values for the cigarettes according to the subject invention were 5.6 mg, 0.73 mg and 25.6 mg, it may be observed that the cigarettes according to the subject invention exhibited synergistic sidestream smoke component reduction effects in respect of PMWNF and TNA.

EXAMPLE IV

First cigarettes in accordance with the subject invention, designated Cigarette 1 in Table 3, comprised 64 mm long cigarette rods of a nominal 25 mm circumference and 20 mm long cellulose acetete filters. The cigarette rods comprised an all lamina cut tobacco filler comprising 80% by weight DIET expanded tobacco and having a density of 175 mg $cm^{-3}$. The rods were wrapped in a cigarette paper as per paper D specified in Table 2.

Second cigarettes in accordance with the subject invention, designed Cigarette 2 in Table 3, were comparable to the just mentioned first cigarette excepting in that the rod filler density was 195 mg $cm^{-3}$ and in that the rod wrappers were of a cigarette paper as per paper C specified in Table 2.

Conventional cigarettes having a rod filler density of 280 mg $cm^{-3}$ and comprising conventional cigarette paper wrappers of an air permeability of 50 Coresta units were employed as control cigarettes.

Results of smoking the control and the first and second inventive cigarettes according to standard machine smoking conditions are shown in Table 3. It is to be observed from these results that whereas the inventive cigarettes exhibited puff numbers comparable to the puff number of the control cigarettes, sidestream smoke component yields for the inventive cigarettes were considerably reduced compared with the control cigarettes. Thus, for example, with the first inventive cigarettes PMWNF was reduced by 70%. It is also to be observed that the ratio of the tobacco consumed during smoulder, i.e. in the inter-puff periods, to the tobacco consumed during the puffs was significantly reduced in comparison with the control cigarettes.

Measurements of tobacco consumption during the puffs and in the inter-puff periods were made using a burn rate monitoring device details of which are given in Tobacco Patents Information Bulletin, No. 88/29-30 published by N. & D. J. Foster, Amberlea, North Road, Dibden Purlieu, Southampton, SO4 5PE, England.

TABLE 3

| | | Sidestream Reductions (%) | | Tobacco Consumption (%) | |
|---|---|---|---|---|---|
| Cigarette | Puff No. | PMWNF | CO | Puffs | Smoulder |
| Control | 8.8 | — | — | 32 | 68 |
| 1 | 8.6 | 70 | 69 | 80 | 20 |
| 2 | 8.0 | 60 | 50 | 60 | 40 |

Figure 2:
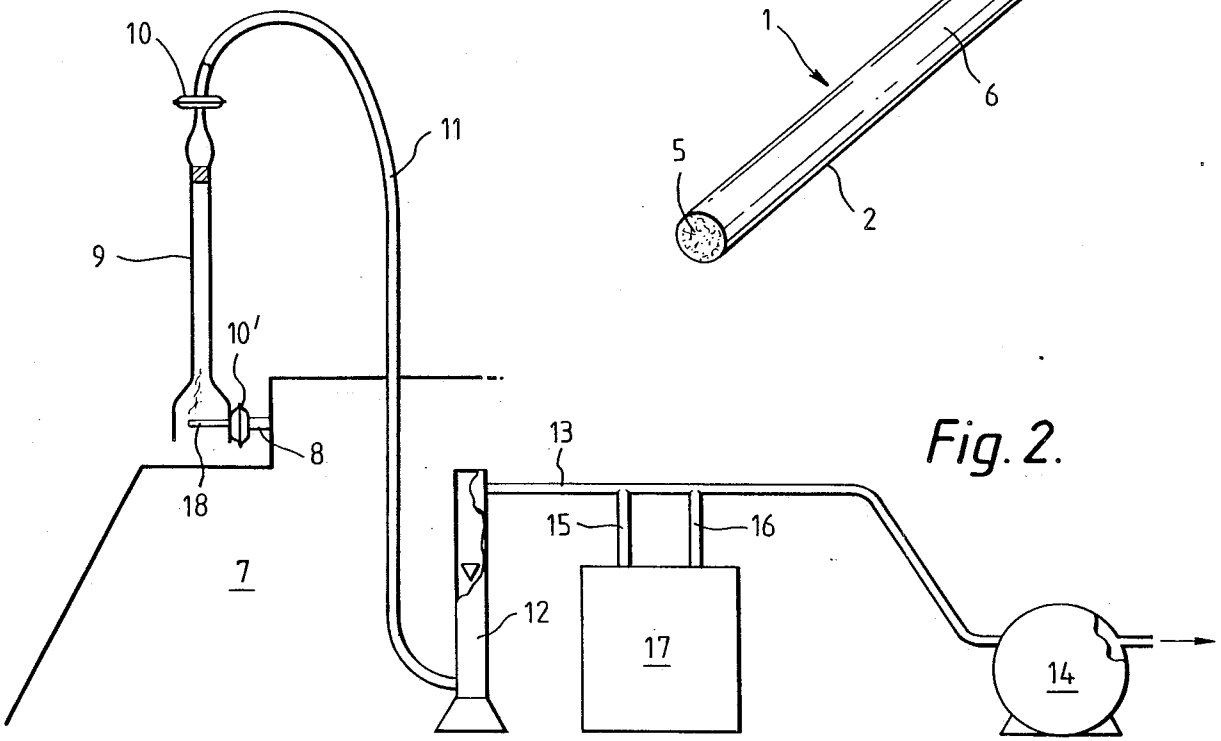
FIG. 2 shows, diagrammatically, apparatus used in making determinations of deliveries of sidestream smoke components

The apparatus shown in FIG. 2 which was used in making the determinations of the above cited deliveries of sidestream smoke components comprised a Filtrona 302 linear smoking machine 7, a port of which is designated by reference numeral 8. At each port of the smoking machine 7 there was vertically disposed an open ended, glass fishtail chimney, that associated with port 8 being designated by reference numeral 9. In FIG. 3 dimensions a and b are 410 mm and 80 mm respectively. In FIG. 4 internal dimension (diameter) c is 24 mm and dimension d is 22 mm. Transversely disposed above chimney 9 was a pre-weighted Cambridge filter pad 10. The item designated by reference numeral 10' is a Cambridge filter pad utilised in the measurement of mainstream smoke component deliveries. A tube 11 extended from the upper side of the filter pad 10 to a gas-flow meter 12, from which meter 12 a tube 13 extended to a gas pump 14. Connected to the pipe 13 by inlet and outlet tubes 15, 16 was an infrared carbon monoxide analyser 17 embodying an internal gas circulation pump (not shown). FIGS. 4 to 6 being views on FIG. 3 taken in the directions of arrows A,B, and C respectively.

In operation of the FIG. 2 apparatus, for the determination of sidestream smoke component deliveries of a cigarette 18 smoked at the port 8 of the smoking machine 7, the pump 14 was set to provide a flow rate through chimney 9, tube 11 and tube 13 of 2.0 liters per minute. During the smoking of the cigarette 18 under standard smoking conditions at the port 8 the sidestream smoke emanating from the cigarette 18 passed up the chimney 9 to the filter pad 10. That portion of the smoke not deposited at the pad 10 or on the interior walls of the chimney 9 passed through tubes 11, 13 and a sub-sample thereof passed through the carbon monoxide analyser 17 by way of the inlet and outlet tubes 15, 16.

When the smoking at port 8 of the cigarette 18 and two identical cigarettes had been completed, the pad 10 was re-weighted. From the weight so determined there was subtracted the original weight of the pad 10, thus to give the weight of total particulate matter (TPM) deposited on the pad 10. The pad 10 was then extracted with an extracting solvent, propan-2-ol for example. The extract so obtain was analysed by gas chromatography to determine the amounts of nicotine and water deposited on the pad 10. The sum of the weights so determined of nicotine and water was subtracted from the above mentioned gravimetrically determined weight of TPM deposited on the pad 10, thus to give the weight of PMWNF there deposited.

The interior of the chimney 9 was rinsed with an extracting solvent, propan-2-ol for example. A portion of the extract so obtained was analysed by gas chromatography to determine the amount of nicotine deposited on the interior walls of the chimney 9. The weight of nicotine so determined was added to the weight of nicotine deposited on the pad 10, thus to give the total weight of sidestream nicotine produced from the three cigarettes, which weight was divided by three to give the weight of sidestream nicotine per cigarette.

The other portion of the extract obtained from the rinsing of the chimney 9 was analysed by an ultra violet technique, in which as a standard was employed a portion of the above referred to extract obtained from the pad 10, to determine the amount of PMWNF deposited on the interior walls of the chimney 9. The weight of PMWNF so determined was added to the weight of PMWNF, as above determined, deposited on the pad 10, thus to give the total weight of sidestream PMWNF produced from the three cigarettes, which weight was divided by three to give the weight of sidestream PMWNF per cigarette.

The sidestream smoke CO yield per cigarette was determined from data obtained from the analyser 17.

We claim:

1. A smoking article comprising a smoking material rod, which rod comprises smoking material and a paper wrapper circumscribing said smoking material, the density of said smoking material in said rod being in a range of about 100 mg $cm^{-3}$ to about 260 mg $cm^{-3}$, said smoking material comprising at least about 20% by weight of expanded tobacco, said wrapper comprising from 2.6% to 14% of a burn retardant and said smoking article, when smoked under standard machine smoking conditions, providing not less than six puffs.

2. A smoking article as claimed in claim 1, wherein said burn retardant deleted and in the place the phrase comprises at least one compound selected from the group consisting of aluminium ammonium sulphate, di-ammonium hydrogen orthophosphate, ammonium dihydrogen orthophosphate, sodium di-hydrogen orthophosphate, boric acid, aluminium borate, calcium borate, ammonium bromide, lithium bromide, magnesium bromide, ammonium chloride, magnesium chloride, zinc chloride, aluminium phosphate, calcium phosphate, potassium silicate, aluminium sulphate, calcium sulphate, magnesium sulphate and sodium carbonate.

3. A smoking article as claimed in claim 1 or 2, wherein said smoking material comprises at least 30% by weight expanded tobacco.

4. A smoking article as claimed in claim 1, wherein said expanded tobacco is tobacco which has been expanded so as to provide an increase in filling value of at least 75%.

5. A smoking article as claimed in claim 1, wherein said expanded tobacco has a bulk density of 100 mg $cm^{-3}$ to 175 mg $cm^{-3}$.

6. A smoking article as claimed in claim 1, wherein the air permeability of said wrapper is not more than 20 Coresta units.

7. A smoking article as claimed in claim 1 wherein said wrapper comprises a sidestream reducing filler substance.

8. A smoking article as claimed in claim 1, wherein the circumference of said smoking material rod is within a range of 20 mm to 30 mm.

9. A smoking article as claimed in claim 1 wherein the circumference of said smoking material rod is within a range of 12.5 mm to 20 mm.

10. A smoking article as claimed in claim 1, which exhibits, when smoked under standard machine smoking conditions, a total yield of sidestream PMWNF not exceeding 17 mg.

11. A smoking article as claimed in claim 1, which exhibits, when smoked under standard machine smoking conditions, a total yield of sidestream carbon monoxide not exceeding 35 mg.

12. A smoking article as claimed in claim 1, which exhibits, when smoked under standard machine smoking conditions, a smoking material consumption not exceeding 50% of the total smoking material consumption.

13. A smoking article comprising a smoking material rod, which rod comprises smoking material and a paper wrapper circumscribing said smoking material, the density of said smoking material in said rod being in a range of about 100 mg $cm^{-3}$ to about 260 mg $cm^{-3}$, said smoking material comprising at least about 20% by weight of expanded tobacco, said wrapper comprising up to about 20% of a water soluble burn retardant and said smoking article, when smoked under standard machine smoking conditions, providing less than six puffs.

14. A smoking article comprising a smoking material rod, which rod comprises smoking material and a paper wrapper circumscribing said smoking material, the density of said smoking material in said rod being in a range of about 100 mg $cm^{-3}$ to about 260 mg $cm^{-3}$, said smoking material comprising at least about 20% by weight of expanded tobacco, said wrapper comprising up to about 30% of a non-water soluble burn retardant and said smoking article, when smoked under standard machine smoking conditions, providing less than six puffs.

* * * * *

UNITED STATES PATENT AND TRADEMARK OFFICE

CERTIFICATE OF CORRECTION

PATENT NO. : 4,964,427

DATED : October 23, 1990

INVENTOR(S) : Paul D. Case and David J. Dittrich

It is certified that error appears in the above-identified patent and that said Letters Patent is hereby corrected as shown below:

Column 7, line 45, after "part of diammonium" delete the phrase "di-hydrogen orthophosphate and 1 part of di-ammonium".

Column 8, line 1, delete the numeral "2.5" and substitute therefor --25--.

Column 9, line 34, delete the word "pre-weighted" and substitute therefor --pre-weighed--.

Column 9, line 62, delete the word "re-weighted" and substitute therefor --re-weighed--.

Column 10, line 44, after "burn retardant" delete the phrase "deleted and in place the phrase".

Signed and Sealed this

Eighteenth Day of August, 1992

*Attest:*

DOUGLAS B. COMER

*Attesting Officer*

*Acting Commissioner of Patents and Trademarks*